US006257931B1

(12) United States Patent
Sakurai et al.

(10) Patent No.: US 6,257,931 B1
(45) Date of Patent: Jul. 10, 2001

(54) SHIELDED CONNECTOR

(75) Inventors: Kazuaki Sakurai; Masahito Ozaki; Noriko Ito, all of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/370,168

(22) Filed: Aug. 9, 1999

(30) Foreign Application Priority Data

Aug. 11, 1998 (JP) ..... 10-226725

(51) Int. Cl.[7] ..... H01R 9/03
(52) U.S. Cl. ..... 439/610; 439/394
(58) Field of Search ..... 439/394, 578, 439/579, 585, 610

(56) References Cited

U.S. PATENT DOCUMENTS

| | | | | |
|---|---|---|---|---|
| 5,180,316 | * | 1/1993 | Miller et al. | 439/610 |
| 5,429,529 | * | 7/1995 | Hashizawa et al. | 439/610 |
| 5,498,176 | * | 3/1996 | Hashizawa et al. | 439/585 |
| 5,501,615 | * | 3/1996 | Inaba et al. | 439/578 |
| 5,618,198 | * | 4/1997 | Masuda et al. | 439/98 |

FOREIGN PATENT DOCUMENTS

| | | |
|---|---|---|
| 0 608 863 | 8/1994 | (EP) . |
| 0 709 929 | 5/1996 | (EP) . |
| 0 800 238 | 10/1997 | (EP) . |
| 7-22107 | 1/1995 | (JP) . |

OTHER PUBLICATIONS

Patent Abstracts of Japan, vol. 199, No. 504, May 31, 1995 & JP 07 022107A (Yazaki) Jan. 24, 1995 *abstract*.

* cited by examiner

*Primary Examiner*—Lincoln Donovan
*Assistant Examiner*—Thanh-Tam Le
(74) *Attorney, Agent, or Firm*—Armstrong, Westerman, Hattori, McLeland & Naughton

(57) ABSTRACT

A shielded connector having a rear opening for putting a shielded wire through is provided with a shielding terminal that is capable of being closed about the wire at the rear opening so as to improve the electrical shield. The shielded connector includes: an inner terminal connected to an inner conductor of a shielded wire having a shielding member; an inner housing to accommodate the inner terminal; a shielding terminal to cover the inner housing and to be connected to the shielding member of the shielded wire; an outer housing to accommodate the shielding terminal; a lid member provided at a rear opening of the shielding terminal and integrally connected therewith through a hinge; and a pressure contact portion formed on the lid member so as to press the shielding member of the shielded wire, wherein the inner terminal is electrically shielded. The shielded connector further includes a spacer having an engaging plate to lock the shielding terminal to the outer housing, which engaging plate has a pressing portion to press the lid member on the shielding member of the shielded wire.

3 Claims, 6 Drawing Sheets

SHIELDED CONNECTOR

BACKGROUND OF THE INVENTION

1. Field of the Invention

The present invention generally relates to a shielded connector and more of particularly, to a shielded connector wherein a rear opening, of a shielding terminal passage for a shielded wire is closed so as to improve electrical shield.

2. Description of the Related Art

FIGS. 14 and 15 show a prior art shielded connector disclosed in Japanese patent application Laid-open No. 7-22107 (hereinafter JP'107).

A shielded connector 92 is made up of an inner terminal 90 connected to an inner conductor 89 of a shielded wire 88, an inner housing 91 to accommodate the inner terminal 90, a shielding terminal 71 to cover the inner housing 91 and to be connected to a shielding mesh 70 of the shielded wire 88, and an outer housing 72 (FIG. 15) to accommodate the shielding terminal 71.

The inner housing 91 is provided with a plate-like lid member 74 on the rear half portion thereof through a hinge 73, which lid member 74 can be freely opened or closed. The lid member 74 is provided with a shielding member 75 of conductive metal, which shielding member 75 is separated from the shielding terminal 71. The lid member 74 has an engaging portion 76 against the inner terminal 90 near the hinge. The shielding member 75 has a rear plate portion 77 with a curved groove (not shown) for dodging the inner conductor 89 of the shielded wire 88, a plate portion 79 with an engaging opening 78 against the inner housing 91, and a projecting portion 81 to be put into contact with an upper wall 80 of the outer housing 72 (FIG. 15).

And, the inner housing 91 is provided with a locking lance 82 for the inner terminal 90, and the outer housing 72 (FIG. 15) is provided with a locking lance 83 for the shielding terminal 71. A front pressure fixing portion 84 of the shielding terminal 71 fixes the shielding mesh 70 of the shielded wire 88, and a rear pressure fixing portion 85 fixes a cover 86 of the shielded wire 88. And, the shielding terminal 71 prevents the inner terminal 90 from receiving or exhausting noise. Especially, since the shielding member 75 closes the rear opening 87 of the inner housing 91 when the lid member 74 is closed, the shielding effect in high frequency bands is improved.

With respect to the above prior art shielded connector, however, since the curved groove for the inner conductor 89 of the shielded wire 88 is formed on the rear plate portion 77 of the shielding member 75 and also a space exists between the rear plate portion 77 and the side plate portion 79 and further the engaging opening 78 exists on the side plate portion 79, shielding of noise is not complete, which requires improvement of shielding effect. And, since the shielding member 75 is formed separately, the number of parts, the steps for mounting the shielding member 75, and the parts represent a cost increase. Further, since assembling work of the small shielding member 75 to the lid member 74 is troublesome, easier assembling work is required.

SUMMARY OF THE INVENTION

In view of the foregoing, an object of the present invention is to provide a shielded connector having a shielding terminal with high shielding effect, wherein number of parts is decreased, the cost and assembling steps are decreased, and the assembling work is simplified.

In order to achieve the above-described object, as a first aspect of the present invention, a shielded connector includes: an inner terminal connected to an inner conductor of a shielded wire with a shielding member; an inner housing to accommodate the inner terminal; a shielding terminal to cover the inner housing and to be connected to the shielding member of the shielded wire; an outer housing to accommodate the shielding terminal; a lid member provided at a rear opening of the shielding terminal integrally therewith through a hinge; and a pressure contact portion formed on the lid member so as to press the shielding member of the shielded wire, wherein the inner terminal is electrically shielded.

According to the above-described structure, since the lid member is integrated with the shielding terminal, effective conductivity exist between the lid member and the shielding terminal, thereby improving the shielding effect for the inner terminal. And, since the lid member is put into pressure-contact with the shielding member of the shielded wire, no space exists between the shielding member and the lid member, which can enhance the shielding effect and the conductivity between the lid member and the shielding member, i.e. contact resistance between the lid member and the shielding member can be reduced, thereby grounding noise from the lid member to the shielding member and then further improving the shielding effect. Further, since the lid member is integrated with the shielding terminal, the number of parts decreases, thereby decreasing the parts cost, and the assembly cost and also simplifying the assembly work.

As a second aspect of the present invention, the shielded connector with the above first aspect further includes a spacer to be inserted into the outer housing through an insertion hole provided thereon, which spacer has an engaging plate to lock the shielding terminal to the outer housing.

According to the above-described structure, the shielding terminal can be double locked to the outer housing by the engaging plate and by another conventional means.

And, as a third aspect of the present invention, in the shielded connector of the above second aspect, the engaging plate of the spacer has a pressing portion to press the lid member on the shielding member of the shielded wire.

According to the above-described structure, since the lid member is put into pressure-contact with the shielding member of the shielded wire, conductivity between the lid member and the shielding member is further heightened and the shielding effect is further improved.

The above and other objects and features of the present invention will become more apparent from the following description taken in conjunction with the accompanying drawings.

DESCRIPTION OF THE PREFERRED EMBODIMENT

An embodiment of the present invention will now be described in further detail with reference to the accompanying drawings.

Figure 1:
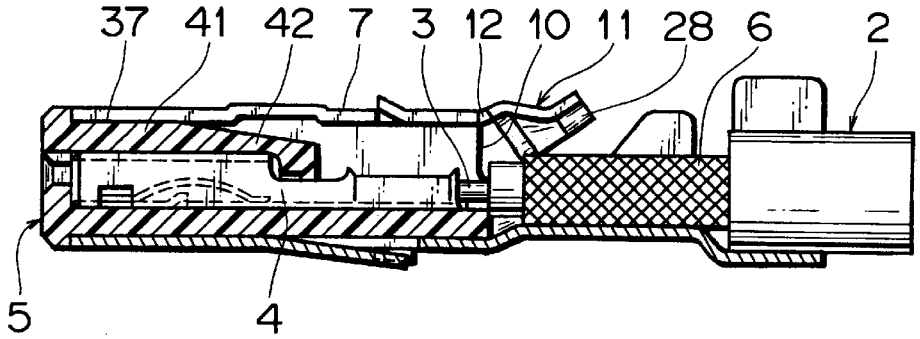
FIG. 1 is a longitudinal sectional view showing an embodiment of a shielded terminal assembly of a shielded connector in accordance with the present invention.
Figure 2:
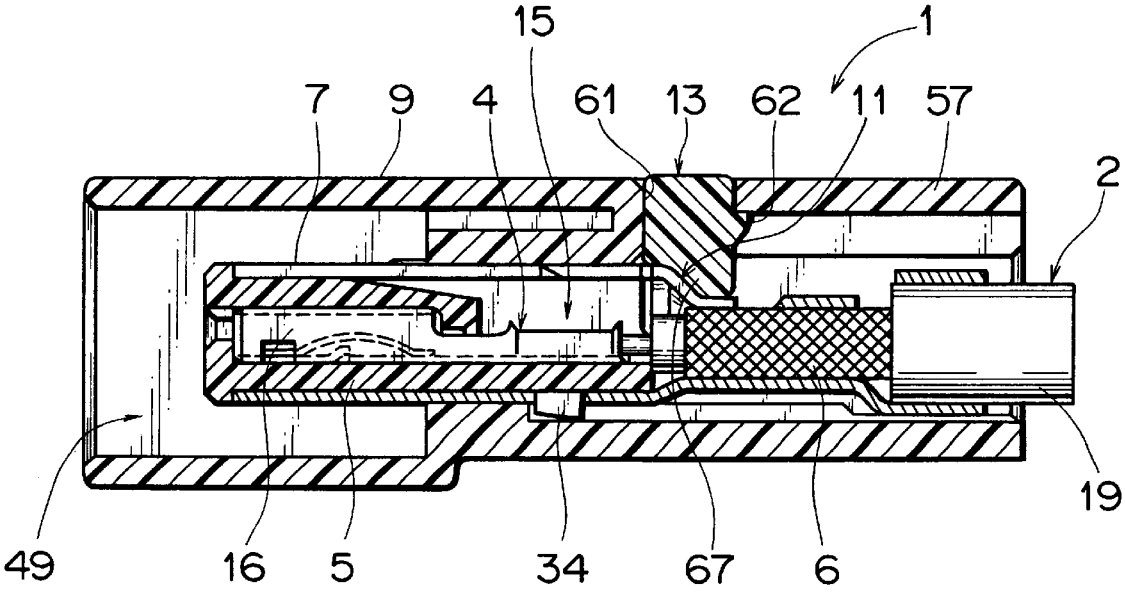
FIG. 2 is a longitudinal sectional view, taken along a line A—A in FIG. 11, showing an embodiment of a shielded connector in accordance with the present invention.

As shown in FIGS. 1 and 2, a shielded connector 1 in accordance with the present invention consists of an inner terminal 4 of conductive metal connected to an inner conductor 3 of a shielded wire 2, an inner housing 5 of insulative resin to accommodate the inner terminal 4, a shielding terminal 7 of conductive metal to cover the inner housing 5 and to be connected to a shielding mesh 6 (a shielding member) of the shielded wire 2, and an outer housing 9 (FIG. 2) of insulative resin to accommodate the shielding terminal 7. And, a lid member 11 to cover a rear opening 10 of the shielding terminal 7 is formed integrally with the shielding terminal 7 through a hinge 12, and the lid member 11 is pressed to the shielding mesh 6 of the shielded wire 2.

As shown in FIG. 2, the lid member 11 is pushed in its closing direction simultaneously with pressing of the shielding mesh 6 and pressing of the cover 19, and after insertion of the inner terminal assembly 15 into the shielded terminal assembly 49, a spacer 13 of synthetic resin is inserted in the outer housing 9. The lid member 11 of the shielding terminal 7 is pushed in the closing direction (the pressing direction of the shielding mesh) by the spacer 13, and thereby the shielding terminal 7 is prevented from coming off.

Hereinafter, structure of the shielded connector 1 is described in detail in the assembling order.

Figure 3:
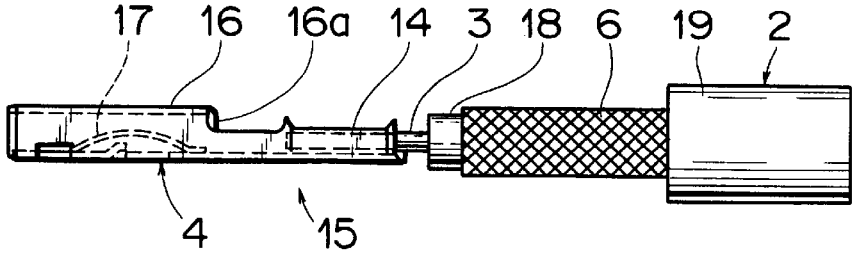
FIG. 3 is a side view showing an inner terminal assembly applied to the shielded connector.

As shown in FIG. 3, the inner terminal assembly 15 is made up of the inner terminal 4 and the inner conductor 3 of the shielded wire 2, which inner conductor 3 is pressure-fixed to a pressure fixing portion 14 of the inner terminal 4. The inner terminal 4 has a box-like electrically contacting portion 16 on one side and the pressure fixing portion 14 on the other hand. The electrically contacting portion 16 is provided with a contact spring-portion 17. The shielded wire 2 is made up of an insulator 18 covering the inner conductor 3, a shielding mesh 6 covering the insulator 18, and a cover 19 covering the shielding mesh 6.

Figure 4:
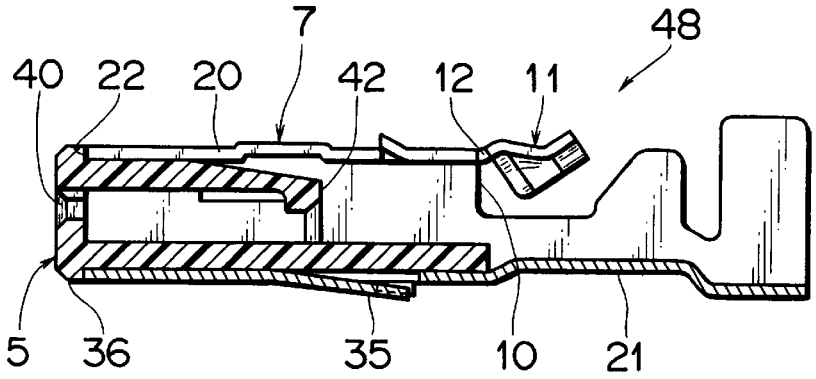
FIG. 4 is a longitudinal sectional view showing a shielding terminal subassembly applied to the shielded connector.
Figure 5:
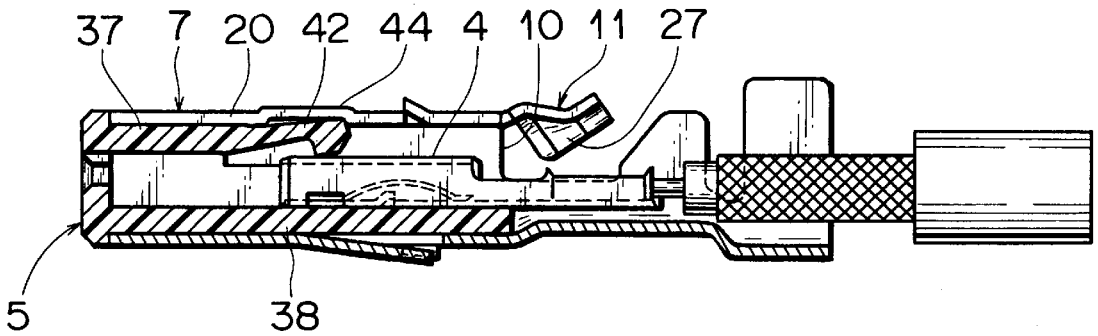
FIG. 5 is a longitudinal sectional view showing a state that the inner terminal assembly is being inserted in the shielding terminal sub-assembly.

Besides the inner terminal assembly 15, as shown in FIG. 4, an inner housing 5 is attached inside the shielding terminal 7, which constitutes a shielding terminal subassembly 48. The shielding terminal 7 has a rectangular-tubular accommodating portion 20 occupying the front half and an electrical wire pressure fixing portion 21 occupying the rear half. The accommodating portion 20 has a front opening 22 to receive the inner housing 5 and a rear opening 10 to receive the inner terminal 4 into the inner housing 5 as shown in FIG. 5.

Figure 6A:
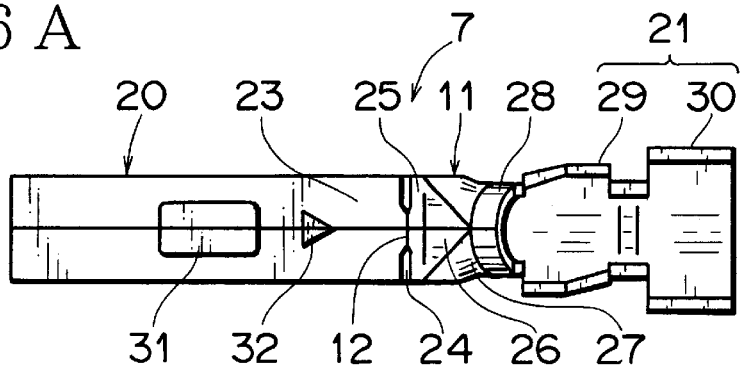
FIG. 6A is a plan view of the shielding terminal.
Figure 6B:
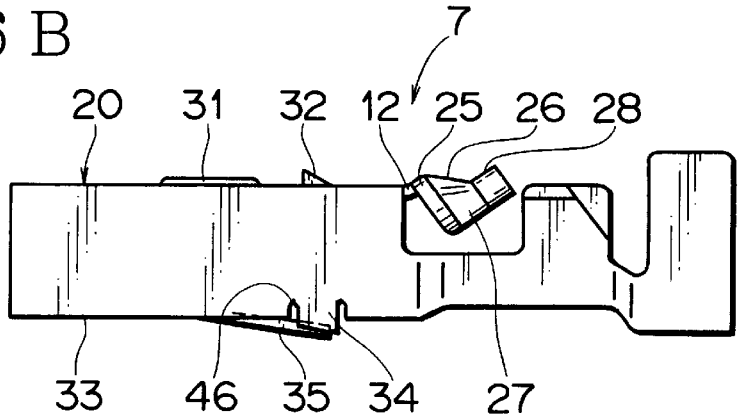
FIG. 6B is a side view of the shielding terminal.

As is also shown in FIGS. 6A and 6B, the shielding terminal 7 is integrally provided with a lid member 11 on the rear top of the accommodating portion 20 through a hinge 12. The hinge 12 extends from an upper wall 23 of the accommodating portion 20 and is formed between notches 24. The lid member 11 has a base portion 25 connected to the hinge 12, a substantially triangular plane portion 26 extending from the base portion 25, curved portions 27 each extending from the plane portion 26, and a semicircular pressure contact portion 28 extending from the curved portions 27. The pressure contact portion 28 presses the shielding mesh 6 of the shielded wire 2 (FIG. 1). The lid member 11 initially lies in a state that the plane portion 26 is substantially in parallel to the upper wall 23 of the accommodating portion 20 so that the inner terminal 4 can pass under the curved portion 27 of the lid member 11, without interfering with the lid member 11 as shown in FIG. 5. As shown in FIG. 6A, in the present embodiment, though the lid member 11 is divided symmetrically with the center of the upper wall 23 so as to surely press the shielding mesh 6 (FIG. 1), an integral one not divided may be used.

As shown in FIGS. 6A and 6B, a pair of relatively smaller front pressure fixing portions 29 and a pair of rear relatively larger pressure fixing portions 30 constitute the electrical wire pressure fixing portion 21 behind the lid member 11. And, on the upper wall 23 of the accommodating portion 20 a projecting portion 31 for positioning itself against the outer housing 9 (FIG. 2) projects, and a forwardly facing engaging piece 32 is formed behind the projecting portion 31. On both sides of a bottom wall 33 of the accommodating portion 20 stability pieces 34 for positioning and stopping the shielding terminal 7 in the outer housing 9 (FIG. 2) are formed to extend downward, and in the middle of the bottom wall 33 a rearward facing resilient engaging piece 35 is formed.

Figure 7A:
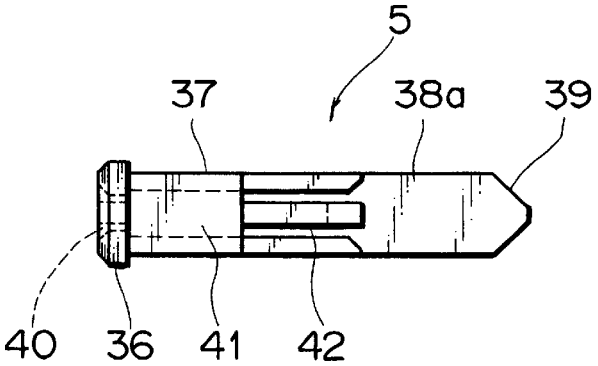
FIG. 7A is a plan view of an inner housing.
Figure 7B:
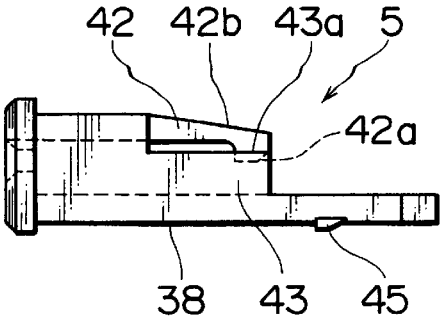
FIG. 7B is a side view of the inner housing.

As shown in FIG. 4, the inner housing 5 is attached in a state that a flange portion 36 at the front end thereof abuts on the front opening of the shielding terminal 7. Also, as shown in FIGS. 7A and 7B, the inner housing 5 has a rectangular tubular accommodating portion 37, whose bottom wall 38 extends rearward. An extending portion 38*a* of the bottom wall 38 is provided with a tapered portion 39 at the front end thereof for easier insertion.

On the front end of the inner housing 5 an insertion hole 40 for a male terminal (not shown) of a mating connector to be connected with the inner terminal 4 (FIG. 1) is provided, and a resilient locking arm 42 having an engaging projection 42*a* for engaging a rear step portion 16*a* of the electrically contacting portion 16 (FIG. 3) of the inner terminal 4 projects from the rear end of the upper wall 41. On both sides of the locking arm 42 notched portions 43*a* of side walls 43 are positioned.

The locking arm 42 has a tapered upper plane 42*b* slanting downward and, as shown in FIG. 5, the locking arm 42 bends upward upon insertion of the inner terminal 4 and enters a recess 44 on the upper wall 23 of the shielding terminal 7, which recess 44 allows the locking arm 42 to bend. Along the bottom wall 38 of the inner housing 5 the inner terminal 4 enters the accommodating portion 37. As shown in FIG. 7B, the bottom wall 38 is provided with an engaging projection 45 that projects against the shielding terminal 4 (FIG. 5). The engaging projection 45 engages a notch 46 inside the stability piece 34 of the shielding terminal 7 shown in FIG. 6B.

As shown in FIG. 1, upon complete insertion of the inner terminal 4 into the inner housing 5, the locking arm 42 resiles downward to lock the inner terminal 4.

The locking arm 42 is disposed in the same plane as the upper wall 41 of the accommodating portion 37, and thus needs no additional space.

Figure 8:
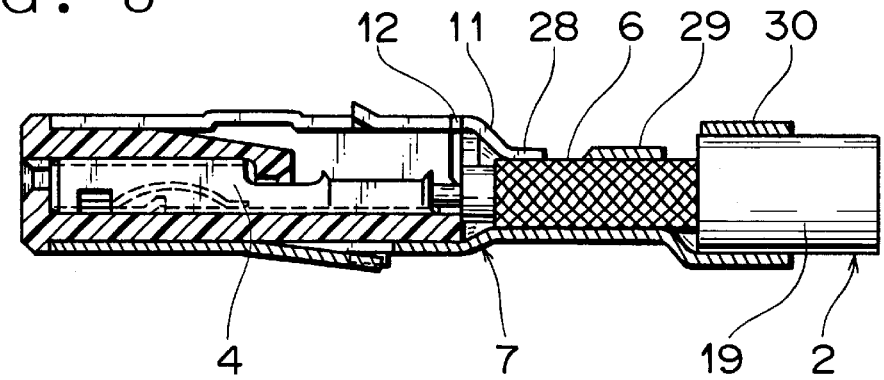
FIG. 8 is a longitudinal sectional view showing the shielded terminal assembly in a state that a lid member of the shielding terminal is put into pressure-contact with a shielding member.
Figure 9:
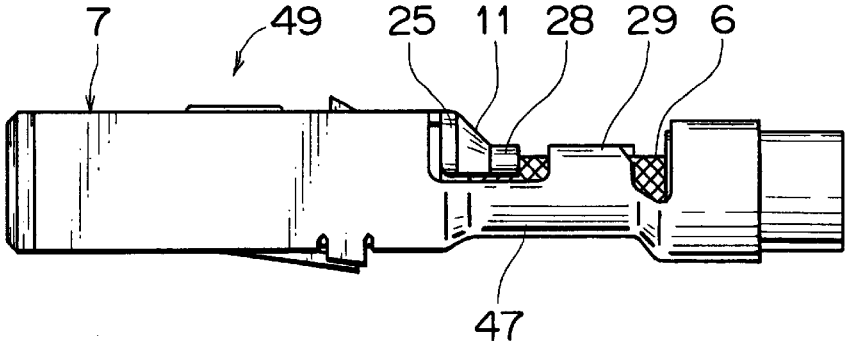
FIG. 9 is a side view of the shielded terminal assembly.

As shown in FIGS. 8 and 9, the lid member 11 of the shielding terminal 7 is closed after the insertion of the inner terminal 4 and is pressed to the shielding mesh 6 of the shielded wire 2. The pressing of the lid member 11 is done simultaneously with pressing of the pressure fixing portions 29,30. The pressure fixing portion 29 is pressed to the shielding mesh 6, and the pressure fixing portion 30 is pressed to the cover 19. The pressing force by the lid member 11 is weaker than that of the pressure fixing portion 29, and the pressure contact portion 28 alone is strongly put into contact with the upper half of the shielding mesh 6.

By strongly putting the lid member 11 into contact with the shielding mesh 6, the lid member 11 is placed in electrical contact with the shielding mesh 6, thereby heightening the shielding effect of the lid member 11. This is promoted by integrally forming the lid member 11 with the shielding terminal 7 through the hinge 12. As shown in FIG. 9, the lower edge of the lid member 11 is almost in contact with a semicircular portion 47 of the shielding terminal 7 and the front end (the base portion 25) of the lid member 11 is also almost in contact with the rear opening of the shielding terminal 7. Like the above, the shielded terminal assembly 49 is completed.

Figure 10:
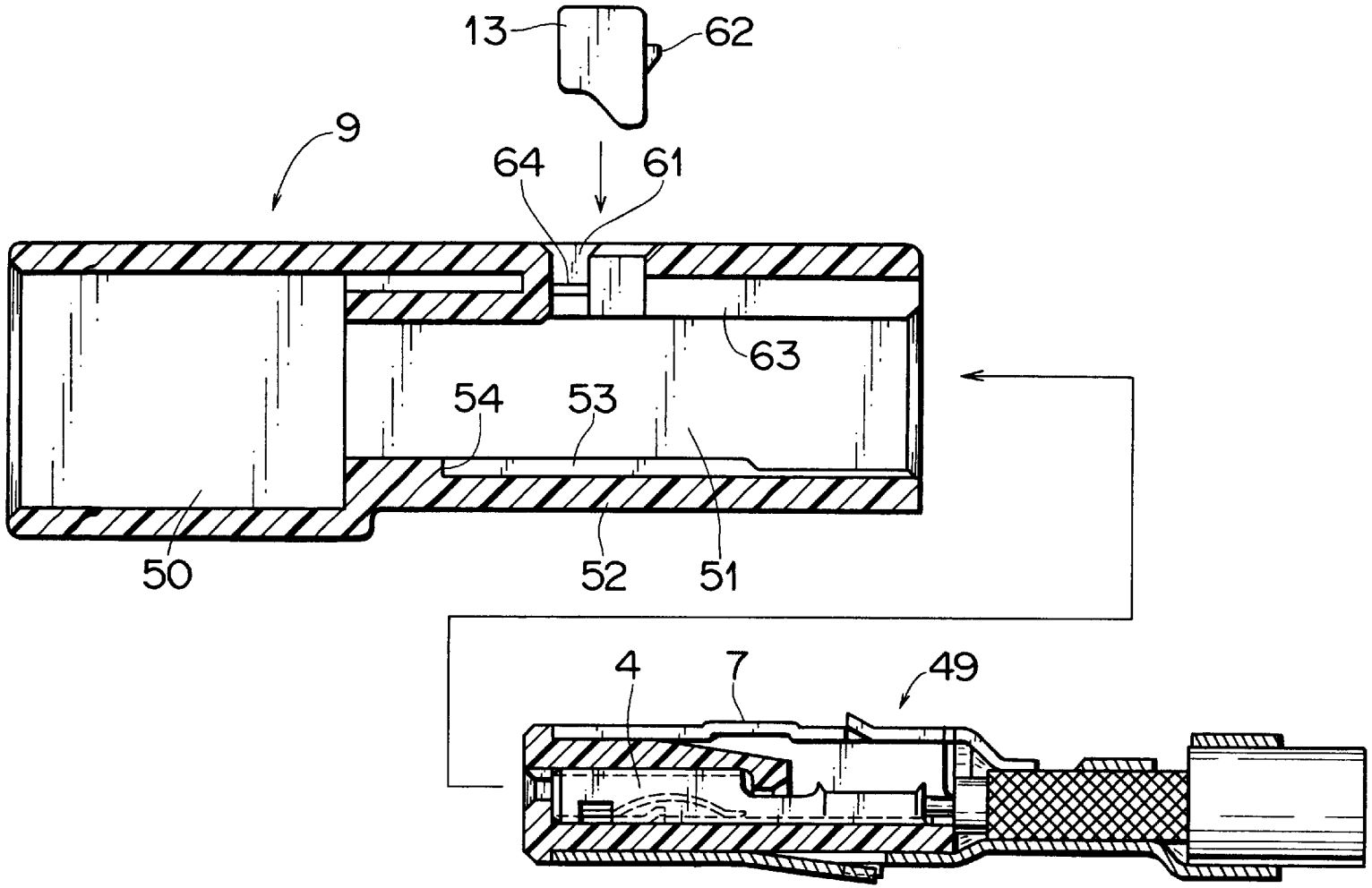
FIG. 10 is a longitudinal sectional view showing a state that the shielded terminal assembly is inserted in an outer housing.
Figure 11:
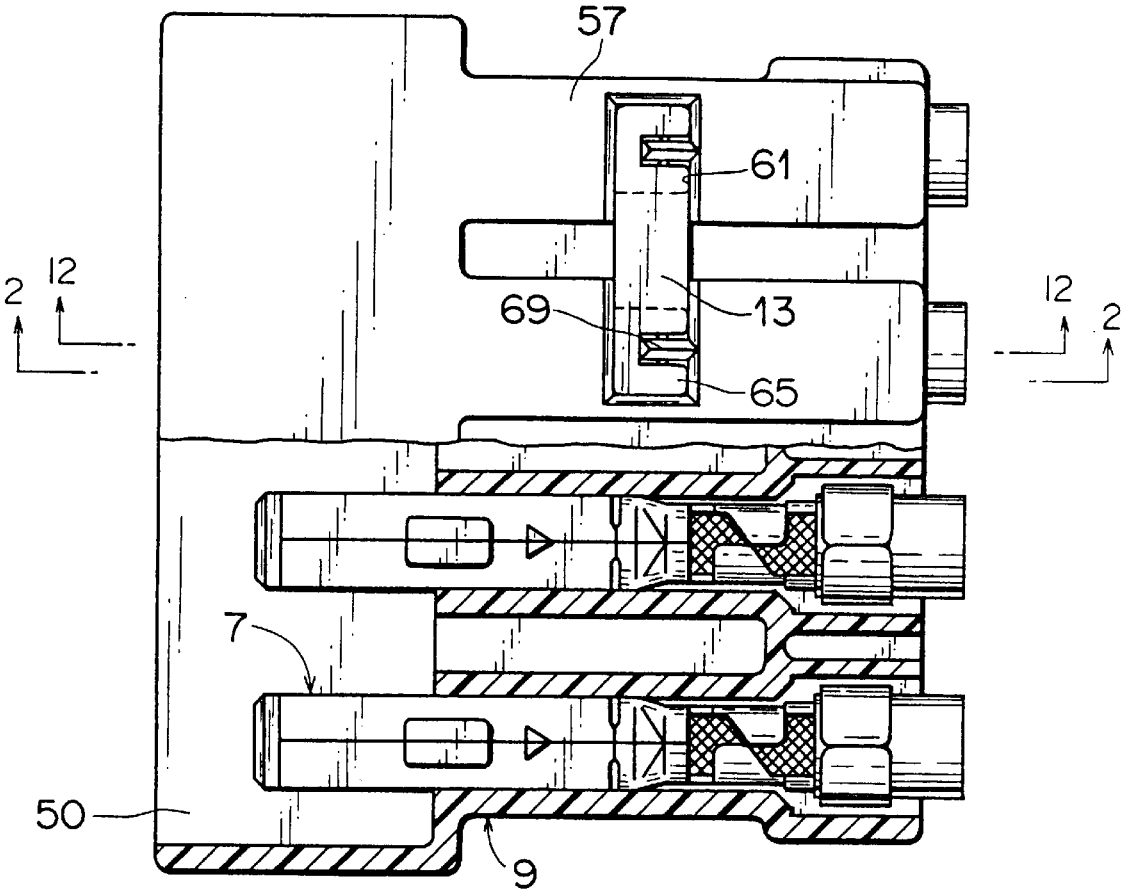
FIG. 11 is a plan view, partly in section, of the shielded connector.

As shown in FIG. 10, the shielded terminal assembly 49 is inserted in the outer housing 9. The outer housing 9 has a connection chamber 50 for a mating connector and an accommodating chamber 51 continuing from the connection chamber 50. As shown in FIGS. 2 and 11, the accommodating chamber 51 accommodates the shielded terminal assembly 49, and the electrically contacting portion 16 of the inner terminal 4 accommodated in the front half portion of the shielding terminal 7 is positioned in the connection chamber 50.

Figure 12:
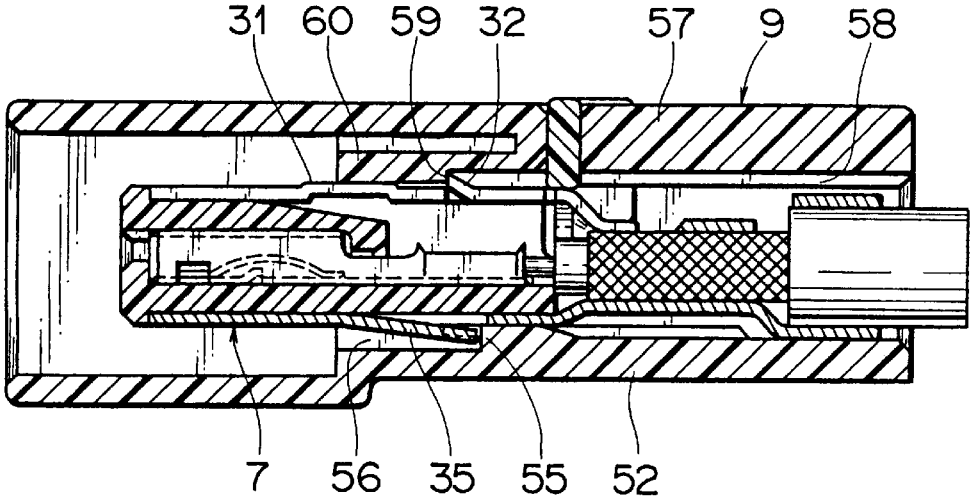
FIG. 12 is a sectional view, taken along a line 12—12 in FIG. 11, of the shielded connector.

As shown in FIG. 10, on a bottom wall 52 of the accommodating chamber 51 a guide groove 53 for the stability piece 34 (FIG. 2) of the shielding terminal 7 and an abutting step 54 at the end of the guide groove 53 are formed. As shown in FIG. 12, on the bottom wall 52 an abutting step 55 against the engaging arm 35 of the shielding terminal 7 and a receiving groove 56 extending forward from the abutting step 55 are formed. On an upper wall 57 of the outer housing 9 a guide groove 58 for the engaging piece 32 of the shielding terminal 7 and an abutting step 59 at the end of the guide groove 58 are formed, and a wall portion 60 to be put into contact with the projecting portion 31 of the shielding terminal 7 continues from the abutting step 59. FIG. 2 is a sectional view taken along a line A—A in FIG. 11, and FIG. 12 is a sectional view taken along a line B–B also in FIG. 11.

As shown in FIGS. 10 and 11, on the upper wall 57 of the outer housing 9 an insertion hole 61 for the spacer 13 is formed. An engaging groove 63 for an engaging projection 62 of the spacer 13 is formed on the rear half portion of the upper wall 57, continuing from the insertion hole 61. A step portion 64 to abut on the spacer 13 is formed in the insertion hole 61.

Figure 13A:
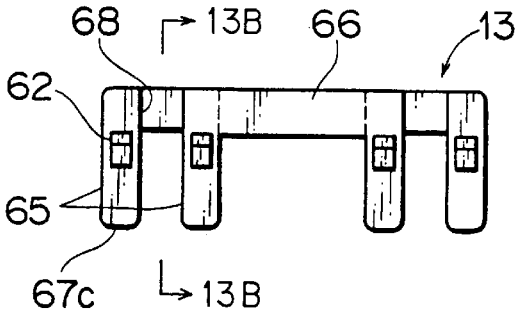
FIG. 13A is a front view of a spacer.
Figure 13B:
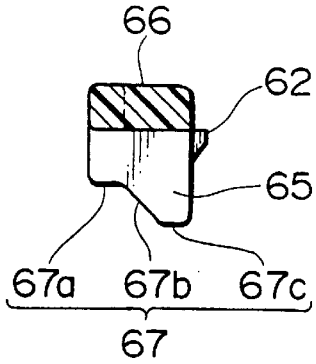
FIG. 13B is a sectional view, taken along a line 13B—13B in FIG. 13A, of the spacer.
Figure 14:
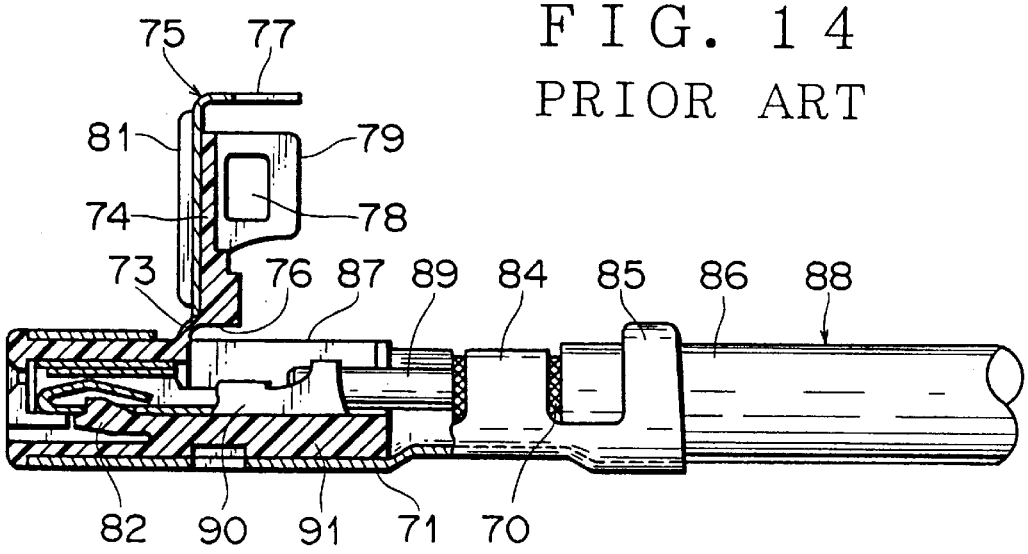
FIG. 14 PRIOR ART
FIG. 14 is a longitudinal sectional view showing a prior art shielded terminal assembly.
Figure 15:
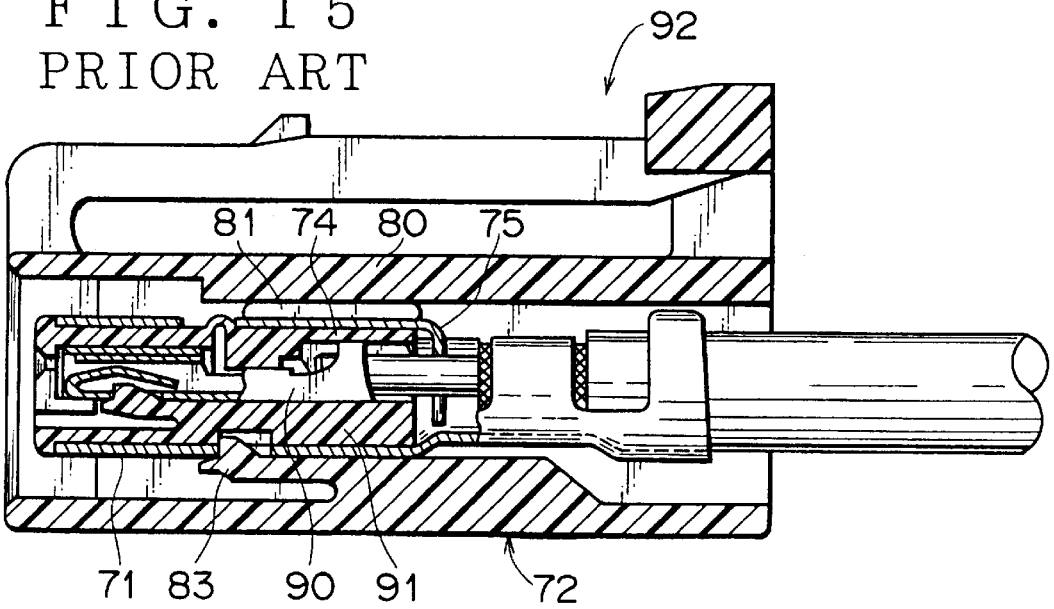
FIG. 15 PRIOR ART
FIG. 15 is a longitudinal sectional view showing the prior art shielded connector.

As shown in FIG. 13A, the spacer 13 has a pair of engaging plates 65 for one shielding terminal 7 (FIG. 11) and thereby the lid member 11 (FIG. 6A), which is divided into two pieces, is surely pressed by the pair of engaging plates 65. The engaging plates 65 are connected to each other by the base plate 66 The engaging plate 65 is provided with the engaging projection 62 on the rear end thereof. The lower portion of the engaging plate 65 is formed in a shape of an outline of the lid member 11 of the shielding terminal 7 (FIG. 2) and has a horizontal plane 67*a* to be put into contact with an upper surface of the base portion 25 (FIG. 6B) of the lid member 11, an inclined plane 67*b* to be put into contact with a curved portion 27 (FIG. 6B) of the lid member 11, and a horizontal plane 67*c* to be put into contact with the pressure contact portion 28 (FIG. 6B) of the lid member 11. The horizontal planes 67*a*,67*c* and the inclined plane 67*b* constitute the pressing portion 67 against the lid member 11. The base plate 66 of the spacer 13 is provided with a notch 68 between a pair of engaging plates 65, with which notch 68 a positioning rib 69 (FIG. 11) on the outer housing 9 engages.

As shown in FIG. 2, the spacer 13 is inserted in the insertion hole 61 of the outer housing 9 and the engaging projection 62 engages the upper wall 57 of the housing. Simultaneously, the bottom of the spacer 13 presses the lid member 11 of the shielding terminal 7 in its closing direction (the pressure contact direction ). This puts the lid member 11 into strong contact with the shielding mesh 6 of the shielded wire 2, thereby further ensuring the shielding by means of the lid member 11. Besides, the lid member 11 prevents the shielding terminal 7 from coming off (i.e. double locking). The shielded terminal assembly 49, the outer housing 9, and the spacer 13 constitute the shielded connector 1 of a female-type.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A shield connector comprising:

an inner terminal having means thereon for attachment to an inner conductor of a shielded wire having a shielding member;

an inner housing to accommodate said inner terminal;

a shielding terminal forming an enclosure operative to cover said inner housing and to be connected to said shielding member of said shielded wire through a rear opening;

an outer housing to accommodate said shielding terminal; and a lid member provided at said rear opening of said shielding terminal and being integrally attached thereto through a hinge, said lid member being positioned, when closed, to close said rear opening and having a pressure contact portion formed thereon operative to engage and press against said shielding member of said shielded wire when said lid member is closed, wherein said inner terminal is electrically shielded.

2. A shield connector comprising:

an inner terminal connected to an inner conductor of a shielded wire with a shielding member:

an inner housing to accommodate said inner terminal;

a shielding terminal to cover said inner housing and to be connected to said shielding member of said shielded wire;

an outer housing to accommodate said shielding terminal;

a lid member provided at a rear opening of said shielding terminal integrally therewith through a hinge;

a pressure contact portion formed on said lid member so as to press said shielding member of said shielded wire;

a spacer inserted into said outer housing through an insertion hole provided thereon, said spacer having an engaging plate to lock said shielding terminal to said outer housing;

wherein said inner terminal is electrically shielded.

3. The shielded connector according to claim 2, wherein said engaging plate of said spacer has a pressing portion to press said lid member on said shielding member of said shielded wire.

* * * * *